US009731936B2

(12) United States Patent
Aulanko et al.

(10) Patent No.: US 9,731,936 B2
(45) Date of Patent: Aug. 15, 2017

(54) ELEVATOR AND A METHOD

(71) Applicants: Esko Aulanko, Kerava (FI); Jaakko Kahila, Karkkila (FI); Matti Räsänen, Hyvinkaa (FI); Mauno Mattila, Hyvinkaa (FI)

(72) Inventors: Esko Aulanko, Kerava (FI); Jaakko Kahila, Karkkila (FI); Matti Räsänen, Hyvinkaa (FI); Mauno Mattila, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 131 days.

(21) Appl. No.: 14/054,073

(22) Filed: Oct. 15, 2013

(65) Prior Publication Data

US 2014/0116811 A1 May 1, 2014

(30) Foreign Application Priority Data

Oct. 30, 2012 (EP) ..... 12190566

(51) Int. Cl.
*B66B 5/00* (2006.01)

(52) U.S. Cl.
CPC ..... *B66B 5/0068* (2013.01)

(58) Field of Classification Search
CPC ..... B66B 5/0068; B66B 5/0056; B66B 5/16; B66B 5/005
See application file for complete search history.

(56) References Cited

U.S. PATENT DOCUMENTS

| | | | | |
|---|---|---|---|---|
| 5,727,657 | A | 3/1998 | Foelix | |
| 2004/0222046 | A1* | 11/2004 | Gut | 187/343 |
| 2008/0099284 | A1 | 5/2008 | Kocher et al. | |
| 2009/0255762 | A1* | 10/2009 | Ketonen et al. | 187/247 |

(Continued)

FOREIGN PATENT DOCUMENTS

| | | | |
|---|---|---|---|
| CN | 101472830 | A | 7/2009 |
| EP | 1118574 | A2 | 7/2001 |

(Continued)

OTHER PUBLICATIONS

European Search Report for EP12190566 dated Apr. 11, 2013.
Office Action issued Nov. 18, 2016 by the Patent Office of SIPO for corresponding Application No. CN 201310522385.3.

*Primary Examiner* — William E Dondero
*Assistant Examiner* — Diem Tran
(74) *Attorney, Agent, or Firm* — Harness, Dickey & Pierce P.L.C.

(57) ABSTRACT

The invention relates to an elevator having a hoistway, an elevator car movable in the hoistway and provided with a car brake, and a first coupling means movably mounted on the car, and a second coupling means mounted separate from the car at proximity of an end of the hoistway, the first and second coupling means being counterparts for each other and provided for being coupled in force-transmitting manner to each other, the car brake being triggerable by movement of the first coupling means. One of the first and second coupling means has coupling points at different vertical levels, and in the other of said first and second coupling means can couple to said one of the first and second coupling means at each of said coupling points. The invention also relates to a method for forming a safety space in the elevator.

18 Claims, 3 Drawing Sheets

(56) References Cited

U.S. PATENT DOCUMENTS

| | | | | |
|---|---|---|---|---|
| 2009/0288920 | A1 | 11/2009 | Kattainen et al. | |
| 2010/0155184 | A1 | 6/2010 | Sirigu et al. | |
| 2011/0083926 | A1* | 4/2011 | Rasanes et al. | 187/300 |
| 2012/0175193 | A1 | 7/2012 | Sirigu et al. | |

FOREIGN PATENT DOCUMENTS

| | | | |
|---|---|---|---|
| WO | WO-2006035264 | A1 | 4/2006 |
| WO | WO-2008004022 | A1 | 1/2008 |
| WO | WO-2008102051 | A1 | 8/2008 |
| WO | WO-2011058229 | A1 | 5/2011 |
| WO | WO-2012137279 | A1 | 10/2012 |
| WO | WO 2014106682 | A1 * | 7/2014 |

* cited by examiner

ELEVATOR AND A METHOD

This application is a continuation of European Patent Application No. EP12190566.5 which has an International filing date of Oct. 30, 2012, the entire contents of which are incorporated herein by reference.

FIELD OF THE INVENTION

The object of the invention is an elevator and a method for forming a safety space. The elevator is particularly meant for transporting passengers and/or goods.

BACKGROUND OF THE INVENTION

Elevator cars typically move vertically up and down in a hoistway. The hoistway is usually a closed space inaccessible to others but maintenance persons. Such situation may arise where a maintenance person needs to get access to elevator components positioned in the hoistway. This type of situation may arise for example when maintenance work, inspection work or installation work needs to be done to the elevator components positioned in the hoistway. The maintenance person can enter the hoistway for example via a door between landing and the hoistway when the car is not blocking the way behind the door opening. Sometimes, to carry out the work it is necessary to stand between the elevator car and the end of the hoistway in the pit floor or on the roof of the elevator car. This poses a threat of being hurt if the car unintentionally moves too far towards the end of the hoistway. These situations can be dangerous, especially if the car can be driven during normal elevator use very close to the end of the hoistway. In prior art, these situations are made safer by activatable safety arrangements, which can stop the car from traveling too close to the end of the hoistway. Such solutions are known, for example, where the car brake can be set to be automatically triggered when the car reaches a predetermined position in the hoistway. In this way, a safety space can be temporarily formed in the end of the hoistway. The elevator car is thus prevented from proceeding into this temporary safety space. Solutions of this type have the problem that the car may be already driven past said predetermined position, when a person activates the system and enters the hoistway. Thus, a person entering the hoistway might be in danger even though he has activated the system for restricting car from moving to its extreme position. Also, it may be unclear for the maintenance person whether it's safe to enter the hoistway or not. Especially in systems where the activation is carried out remotely it may be unclear whether the safety system is reliably activated or not. This problem could be overcome by setting said predetermined position so close to the end of the hoistway that the person entering the hoistway can visually verify that the car is above said predetermined position and that the safety system is correctly activated. However, this necessitates relying on visual observation, which may be difficult of even forgotten. Thus, this alternative is not totally free of risk. Also, if said predetermined position is set close to the hoistway end, the safety space may become too low, because after passing said predetermined position of triggering the brake the car still continues a certain unpredictable braking distance until the car brake is fully stopped. Accordingly, also setting said predetermined position close to the end of the hoistway has drawbacks. Known solutions for providing a temporary safety space are disclosed for example in publications US2008099284A1, EP1118574A2 and U.S. Pat. No. 5,727,657A.

It is common in elevators to form a safety space in upper and lower end of the elevator in the same way. In these cases, the devices meant to work at upper end of the hoistway work otherwise similarly as the devices at the lower end, but they are arranged to work oppositely in the vertical sense. Also in the above described elevators having a predetermined position for triggering the car brake (i.e. elevators with pretriggering safety devices) a safety space can be formed in the upper and lower end of the hoistway in the same way.

BRIEF DESCRIPTION OF THE INVENTION

The object of the invention is to introduce an elevator and a method, where safety is improved. The object of the invention is, inter alia, to solve previously described drawbacks of known solutions and problems discussed later in the description of the invention. Embodiments are presented, inter alia, where a safety space can be reliably formed at the end of an elevator hoistway also when the car is positioned close to said end. Also, embodiments are presented where after creation of the safety space at the end of an elevator hoistway when the car is close to said end, substantial subsequent movement of the elevator car towards said end can be efficiently limited irrespective of the specific location of the car.

It is brought forward a new elevator. In a preferred embodiment of the invention, the elevator comprises a hoistway, an elevator car movable in the hoistway and provided with a car brake, and a first coupling means movably mounted on the car, and a second coupling means mounted separate from the car at proximity of an end of the hoistway, the first and second coupling means being counterparts for each other and provided for being coupled in force-transmitting manner to each other, the car brake being triggerable by movement of the first coupling means. One of the first and second coupling means has coupling points at different vertical levels, and the other of said first and second coupling means can couple to said one of the first and second coupling means at each of said coupling points. In this way, coupling can be carried out in plural positions of the car. Thus, dependency of the car position is decreased. Reliability in forming a safety space at the end of an elevator hoistway can be increased in cases when the car is positioned close to said end. Said end may be the upper end or the lower end of the elevator hoistway.

In a preferred embodiment said one of the first and second coupling means comprises coupling members at (said) different vertical levels for forming said coupling points, each of the coupling members being suitable for being coupled with a coupling member of the other one of said first and second coupling means. In this way said coupling points can be simply and reliably realized.

In a preferred embodiment said first and second coupling means are positioned relative to each other such that said coupling points successively pass or are successively passed by said other of the first and second coupling means when car moves towards said end of the hoistway with unidirectional movement. Thus, the coupling point, where coupling would happen should the coupling be activated, changes as the unidirectional movement of the car progresses. In this way, if the car is stopped close to the end of the hoistway, a coupling point is always close to its counterpart. Accordingly, dependence of car position can be reduced and reliability of coupling is improved.

In a preferred embodiment a free and laterally open space is located at the end-side of (below each of said coupling members in case said end is the lower end, and above in case said end is the upper end) each of said coupling members at different vertical levels into which space a coupling member of the other of said first and second coupling means can be laterally moved by moving coupling member(s) of either one of said coupling means. In this way, a reliable coupling is achieved. Also, in this way it is provided a reliable way to make the system activatable.

In a preferred embodiment a free and laterally open space is located vertically between successive coupling members at different vertical levels into which space a coupling member of the other of said first and second coupling means can be laterally moved by moving coupling member(s) of either one of said coupling means (preferably by moving coupling member(s) of said second coupling means). In this way, a reliable coupling is achieved. Also, in this way it is provided a reliable way to make the system activatable.

In a preferred embodiment said coupling points include at least 3 coupling points at different vertical levels. Thus, there's at least one coupling point between the uppermost and lowermost coupling points. In this way, the dependency of the car position can be considerably reduced by making the distance between the uppermost and lowermost coupling point long, yet still having the benefit that should the counterpart for said coupling points happen to be positioned between the uppermost and lowermost coupling point at the time of activation for coupling the car movement can be rapidly stopped as the gap between successive coupling points can be shorter than the distance between the uppermost and lowermost coupling point long.

In a preferred embodiment said coupling points include at least 5, preferably at least 8, more preferably at least 10 coupling points at different vertical levels. In this way, the coupling can be made possible with a long distance between the uppermost and lowermost coupling point such that any movement of the elevator car towards said end subsequent an activation for coupling can be efficiently limited to be very short. In this way, should the car start moving after the activation for coupling, the car movement is rapidly stopped.

In a preferred embodiment said coupling points are distributed over a vertical length less than 3 meters. Accordingly, it is preferably that said coupling points include coupling points which are less than 3 meters apart. In this way, the coupling means having said coupling points at different vertical levels are not excessively large. Thus, the coupling means having said coupling points may be the first coupling means mounted on the car without adding any excessively large components on the car. Also, in this way the car brake triggering is avoided in considerable height of the hoistway. Thus, the car can moved normally in considerable height of the hoistway.

In a preferred embodiment said coupling points are distributed over a vertical length of more than 1 meters, more preferably at least 1.5 meters. Accordingly, it is preferably that said coupling points include coupling points which are more than 1 meter, preferably more than 1.5 meters apart, such as a lowermost coupling member and an uppermost coupling member having preferably more than 1 meter, preferably at least 1.5 meters distance between them. In this way, it is provided a range of vertical position of the car where coupling is possible. Making this range long a substantial independency of the car position can be provided. Most preferably, said coupling points are distributed over a vertical length of more than 1.5 meters, and less than 3 meters. Then, the positive and negative effects of the arrangement are well balanced.

In a preferred embodiment said coupling points include coupling points which are less than 50 cm apart, more preferably less than 30 cm apart. When the density of the coupling points is this high, should the coupling point and corresponding counterpart not be optimally spaced even though coupling is activated and the car is within the zone of coupling, it can be ensured that brake triggering movement happens after the car has moved only a short distance. Also, the car speed cannot rise dangerously high before the brake triggering takes place.

In a preferred embodiment said coupling points comprise a lowermost coupling point and an uppermost coupling point and a coupling point or plurality of coupling points between the lowermost and the uppermost coupling point, all at different vertical levels. For enabling this, in a preferred embodiment said coupling members comprise a lowermost coupling member and an uppermost coupling member and a coupling member or plurality of coupling members between the lowermost and an uppermost coupling member, all at different vertical levels. In this way, density of the coupling points can be made higher and multiple positions for the car, where coupling is possible, can be achieved.

In a preferred embodiment said plurality of coupling members for forming of said coupling points are rigidly connected to each other.

In a preferred embodiment said coupling means having said coupling points at different levels comprises a vertically elongated structure comprising said coupling members for forming said coupling points. Preferably, said vertically elongated structure is a vertically elongated rigid object. Thus, it can be simply manufactured and mounted.

In a preferred embodiment said vertically elongated structure comprises a vertically elongated plate having a plurality of edges forming said coupling members at different levels. The edges may face towards said end of the hoistway. Thus, a laterally free space can be easily formed at the end-side of them so as to provide a space for receiving a coupling member of another coupling means. The elongated plate may have a plurality of vertically spaced cutouts forming said edges. In this way, plural coupling members can be cost efficiently formed. Preferably, said plate is placed parallel with the car wall. Thus, space efficiency of the arrangement can be facilitated.

In a preferred embodiment said plate is comprised in the first coupling means and thereby mounted movably on the car. Thus, the car brake is triggerable by movement of the plate. The arrangement can then simply be formed space efficient and well-functioning.

In a preferred embodiment coupling of said coupling means to each other is caused by moving a coupling member of the first coupling means and a coupling member of the second coupling means into contact by relative movement of them. This can be caused by movement of one or both of them. Said relative movement may be cause in different ways depending on the situation. For example movement of the car can cause the coupling to be realized after the coupling members are earlier moved to collision course with each other.

In a preferred embodiment movement of the car to a predetermined direction is arranged to cause said car-brake-triggering movement of the first coupling means. Preferably car-brake-triggering movement of the first coupling means is movement of a coupling member thereof, when it is coupled with the second coupling means, in particular with a coupling member thereof.

In a preferred embodiment the second coupling means is mounted on a stationary structure. This kind of structure may be for example a guide rail. The second coupling means may thus take the support force from the stationary structure for limiting or blocking the vertical movement of the first coupling means when they are in coupled condition. Thus, the car-brake-triggering movement of the first coupling means can be simply and reliably achieved.

In a preferred embodiment the elevator can be set, to and away from an activated condition, in which activated condition coupling between said first and second coupling means is possible, especially in which activated condition coupling between said first and second coupling means takes place if the car is in such a position or is later moved to such a position where said first and second coupling means are level with each other. In this way the safety space can be simply formed to be temporary. Preferably the elevator can be set, to and away from an activated condition by moving coupling member(s) of the first and second coupling means on or away from collision course.

In a preferred embodiment one of the first and second coupling means has coupling member(s) laterally movable to and away from a position wherein it/they is/are on collision course with coupling member(s) of the other of the first and second coupling means. Preferably, the second coupling means is in this way movable.

In a preferred embodiment said laterally movable coupling member(s) is/are laterally movable by pivoting.

In a preferred embodiment said movable coupling member(s) is/are laterally movable by pivoting around an axis parallel to the above mentioned plate and/or car wall. In this way, the space efficiency of the arrangement is improved.

In a preferred embodiment the second coupling means blocks or at least limits vertical movement of the first coupling means, especially coupling members thereof, when they are coupled to each other. Thus, the car-brake-triggering movement of the first coupling means can be simply and reliably achieved.

In a preferred embodiment the elevator comprises means for remotely setting the elevator at least to an activated condition. In particular, preferably embodiment the elevator comprises means for remotely causing said movement of the coupling member(s) to or from the collision course. Preferably, said means for remotely setting are operable by a person.

In a preferred embodiment, all the coupling members of the second coupling means are positioned vertically between halfway of the hoistway and the end of the hoistway.

In a preferred embodiment the second coupling means is positioned at proximity of an end of the of the hoistway, and when the coupling means are coupled movement of the first coupling means away from the end is configured to release the coupling, and movement of the first coupling means, especially coupling member(s) thereof, towards the end is configured to be blocked or at least resisted by the second coupling means, especially by coupling members thereof. Thus movement of the car to safe direction during coupling does not cause said brake triggering movement of the first coupling means, and movement of the car downwards causes said brake triggering movement of the first coupling means. Thus, unnecessary brake triggering can be avoided.

It is also brought forward a new method for forming a safety space between elevator car and an end of the elevator hoistway. In a preferred embodiment of the invention, the elevator is as defined anywhere above, and in the method before a person enters the hoistway the elevator is temporarily set to activated condition, in which activated condition coupling between said first and second coupling means takes place if the car is in such a position or is later moved to such a position where said first and second coupling means are level with each other.

In a preferred embodiment after person exits the hoistway, the elevator is set away from said activated condition to inactivated condition, in which inactivated condition coupling between said first and second coupling means is not possible.

In a preferred embodiment the elevator is set to activated condition by moving the coupling members of the first and second coupling means on collision course with each other.

In a preferred embodiment the elevator is set to activated condition by moving the coupling member(s) of the second coupling means laterally to be on collision course with coupling members of the first coupling means.

The elevator as describe anywhere above is preferably installed inside a building, the car traveling vertically. Preferably, the car has an interior space suitable for receiving a passenger or passengers. The car is preferably arranged to serve two or more landings. The car preferably responds to landing calls and/or car calls so as to serve persons on the landing(s) and/or inside the elevator car.

BRIEF DESCRIPTION OF THE DRAWINGS

In the following, the present invention will be described in more detail by way of example and with reference to the attached drawings, in which.

DETAILED DESCRIPTION

Figure 1:
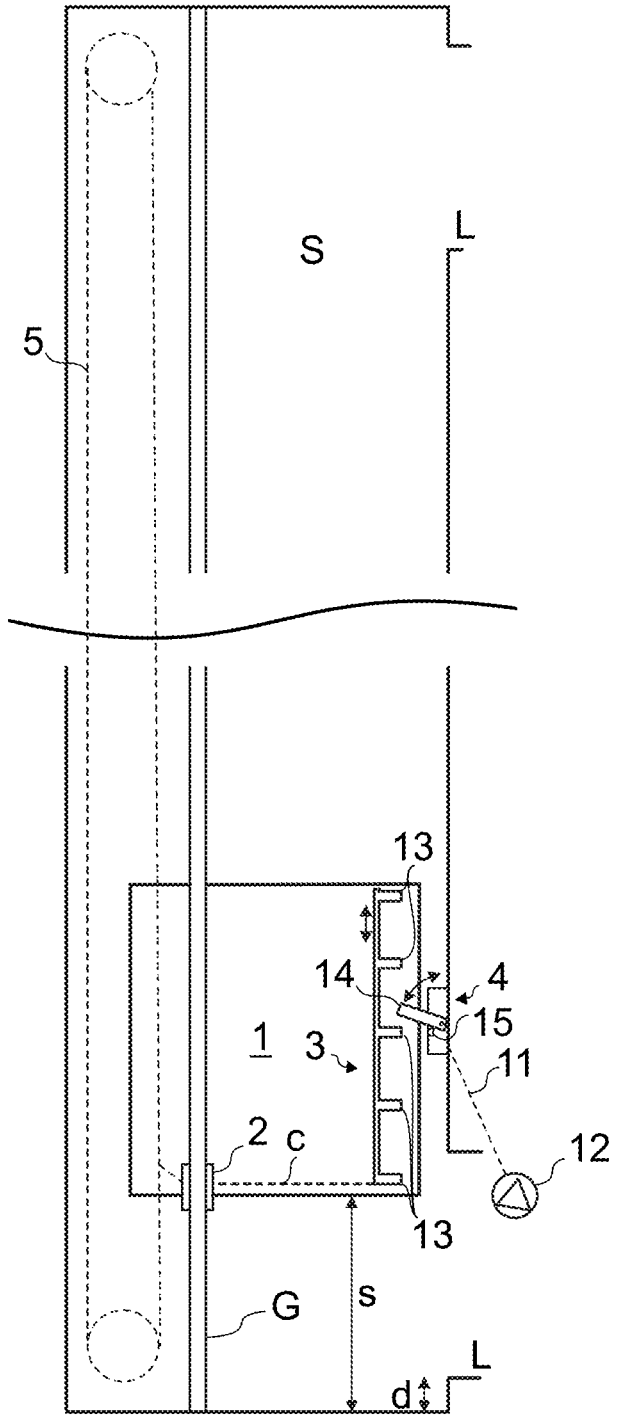
FIG. 1 illustrates schematically an elevator according to an embodiment of the invention.
Figure 2:
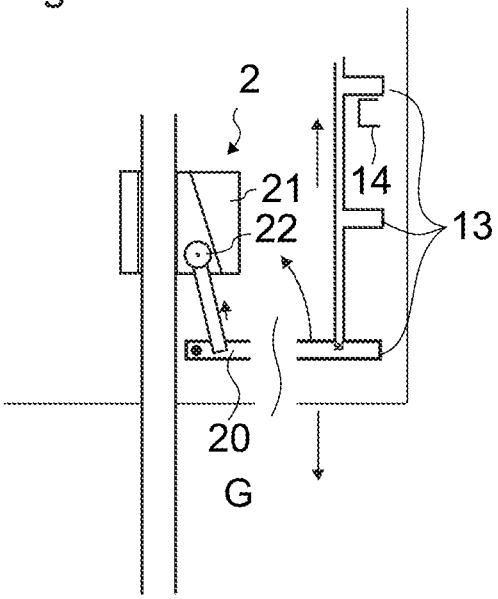
FIG. 2 illustrates a preferred structure for the embodiment of FIG. 1.
Figure 3:
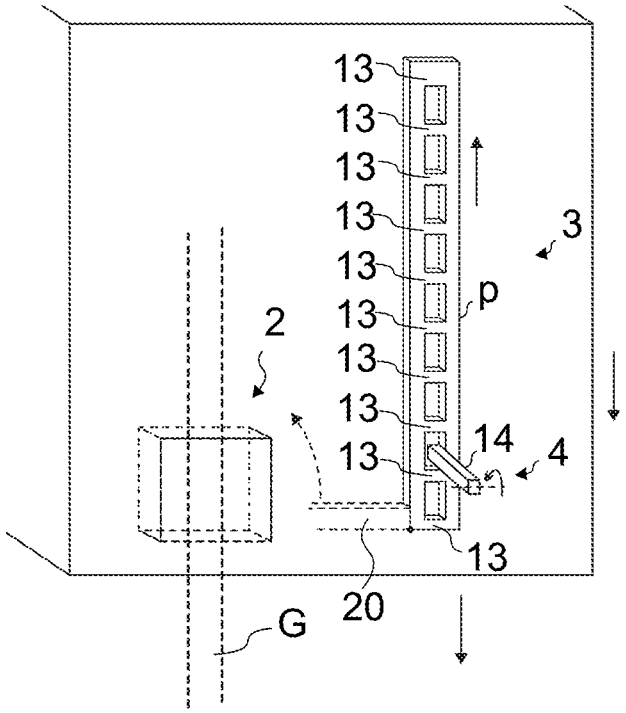
FIG. 3 illustrates a preferred structure for the first and second coupling means of the embodiment of FIG. 1, and their co-operation.

FIG. 1 illustrates an elevator according to a preferred embodiment. The elevator comprises an elevator car 1 arranged to travel vertically in an elevator hoistway S. The hoistway S comprises a pit floor and a ceiling, between which the elevator car travels serving landings L. The car 1 can travel within a hoistway, its traveling zone being ultimately limited by ends of the hoistway. The elevator car 1 is provided with a car brake 2 suitable for braking the movement of the car 1, and a first coupling means 3 vertically movably mounted on the car 1, and a second coupling means 4 mounted separate from the car 1 at proximity of an end of the hoistway. In this case, the second coupling means 4 are mounted on a stationary structure of the hoistway S and positioned inside the hoistway S. The first and second coupling means (3,4) are counterparts for each other and they are provided for being coupled in force-transmitting manner to each other. For this purpose, the first coupling means 3 comprises movable coupling members 13, i.e. coupling members 13 mounted movably on the car 1, which coupling members 13 are suitable for being coupled with coupling member(s) 14 comprised in the second coupling means. The first coupling means 3 has plurality of coupling points at different vertical levels, and said second coupling means 4 can couple to the first coupling means 3 at each of said coupling points. Thus, the elevator car 1 need not be in one specific location for the coupling to be possible, but there are plural vertical positions for the elevator car 1 where coupling between the first and second coupling means is possible. The car brake 2 is functionally connected to the first coupling means 3 such that it is triggerable by movement of the first coupling means 3 vertically, especially by movement of movable coupling member(s) 13 of the first coupling means 3. Thereby, when the first and second coupling means 3, 4 are coupled to each other, movement of the car will cause the second coupling means 4, especially the coupling members 14 thereof, to block downwards directed vertical movement of the first coupling means 3, especially vertical movement of coupling member(s) 13 thereof. Thus, movement of the car 1 downwards causes said brake triggering movement of the first coupling means 3 (in this case movement of the coupling member(s) 13 upwards relative to car 1). The connection c between the brake 2 and the first coupling means 3 may be mechanical, e.g. as it is illustrated in FIGS. 2 and 3, but also other connection types, such as an electromechanical connection, are possible. The brake 2 is preferably a brake that can grip elevator guide rails G, such as guide rails for guiding elevator car 1.

Said coupling points at different vertical levels are realized in the preferred embodiment by coupling members 13 for forming said coupling points, which are at different vertical levels, each of the coupling members 13 being suitable for being coupled with a coupling member 14 of the second coupling means 4.

Said first and second coupling means (3,4) are positioned relative to each other such that said coupling points, in particular the coupling members 13 for forming the coupling points, can successively pass the second coupling means 4, in particular the coupling member(s) 14 thereof, when the car 1 moves towards said end of the hoistway with unidirectional movement. To enable the passing, the second coupling means 4, including the coupling member(s) 14 thereof, are positioned in this preferred embodiment at proximity of the end of the hoistway. In this preferred embodiment, said end of the hoistway is the lower end of the hoistway. Said passing makes it possible that the car can travel full length of said traveling zone towards said end when the elevator is in a normal state where coupling between said coupling means 3,4 is not intended/caused. When the elevator is in a state where said coupling is intended, said coupling is caused when the coupling means 3 and 4 level with each other. Consequently, said passing is not possible and the elevator car cannot travel the full length of its traveling zone towards said end.

The elevator can be set to and away from an activated condition where coupling is possible. In particular, the elevator can be set to and away from an activated condition, in which activated condition coupling between said first and second coupling means takes place if the car is in such a position or is later moved to such a position where said first and second coupling means are level with each other. In the preferred embodiment the elevator can be set to this activated condition by moving coupling member(s) 13,14 of the first and second coupling means 3,4 to a collision course as illustrated in FIGS. 1 to 3. Correspondingly, the elevator can be set back to deactivated condition where coupling is not possible, by moving coupling member(s) 13,14 of the first and second coupling means 3,4 away from a collision course. To enable said moving of the coupling members 13,14 to collision course, one of the first and second coupling means (3,4) has coupling member(s) laterally movable to and away from a position wherein it/they is/are on collision course with coupling member(s) of the other of the first and second coupling means (3,4), in such condition their vertical projections can overlap and collision follows in case the elevator car moves so that they collide. In the illustrated embodiments, the coupling member 14 of the second coupling means is said laterally movable coupling member. Alternatively, the coupling members 13 of the first coupling means could be movable in said manner. Coupling of said coupling means (3,4) to each other is caused by moving a coupling member 13 of the first coupling means 3 and a coupling member 14 of the second coupling means 4 into contact by relative movement of them. As there are plural coupling points at different vertical levels, particularly plurality of coupling members 13 at different vertical levels comprised in one of the coupling means 3,4, coupling can take place even when some of the coupling members 13 have already passed the coupling member 14. In this type of situation there are still some coupling members at opposite side (in Figures above) of the coupling member 14 of the second coupling means 4, which can cause brake triggering movement to the first coupling means 4. The vertical distance between coupling points can be dimensioned short, which causes that the car can be moved at most a short distance towards the end of the traveling zone after moving the elevator to activated condition. Thus, the car can be stopped from moving much closer to the pit floor. This is important especially when the car is close to pit floor at the time of moving the elevator to activated condition with an intention to access the hoistway below the car 1. Accordingly, the arrangement makes it possible to secure a safety space between the pit floor and the car safely and reliably even when the car is close to the pit floor at the moment of activation. However, the arrangement makes it possible that the car can move above the second coupling means 4 freely even when the elevator is in said activated condition.

Said coupling points include several coupling points at different vertical levels. Said coupling points preferably include at least 5, preferably at least 8, more preferably at least 10 coupling points at different vertical levels. In the preferred embodiment of FIG. 1 there are 10 coupling points formed by 10 coupling members 13. Said coupling points are distributed over a vertical length which is preferably less than 3 meters and more than 1 meters, more preferably at least 1.5 meters, most preferably at least 2 meters. In the embodiments shown this length is around 2 meters. As one aim is to achieve rapid stopping of the car after coupling, said coupling points include coupling points which are less than 50 cm apart, more preferably less than 30 cm apart. These same dimensions are of course preferable with the coupling members 13 as well. Said coupling members 13 at different vertical levels comprise a lowermost coupling member and an uppermost coupling member and a coupling member 13 or plurality of coupling members 13 between the lowermost and an uppermost coupling member, all at different vertical levels. Said coupling members 13 at different vertical levels comprise a lowermost coupling member and an uppermost coupling member having preferably at least 1 meter distance between them.

The elevator as shown in FIG. 1 comprises the means 11, 12 for remotely setting the elevator at least to an activated condition. By operating said means 11, 12 said movement of the coupling member(s) to or from the collision course can be caused. In the preferred embodiment, said means are operable by a person intending to enter the hoistway S. Said means 11,12 are accessible from the landing L closest said end of the traveling path. They comprise an interface 12 connected to coupling means 4 for moving the coupling members or the coupling means 3,4 to collision course when operated. The interface 12 may be in the form of a lever rotatable by a triangular key, which interface is common in elevators to be used by maintenance persons for opening elevator doors. As an alternative to said interface, the means 11,12 for remotely setting the elevator at least to an activated condition could comprise a door position sensing means, such as sensor, operatively connected to coupling means 4 for moving the coupling members 13,14 or the coupling means 3,4 to collision course if a door leading to the hoistway is opened. Presence of said means 11,12 is preferable for the sake of safety, but not necessary, because said lateral movement of the laterally movable coupling member 14 could be caused also manually after entering the hoistway.

Force for moving said lateral movement of the laterally movable coupling member 14 such that coupling members 13, and 14 of the first and second coupling means are on collision course may be produced in many alternative ways. For example, the movable coupling member 14 may be arranged to be moved with manual force or by releasing the coupling member to be moved by gravity force or by releasing the coupling member to be moved by a force of a spring means, such as a spring or equivalent for producing a force for moving the coupling members 14. In the preferred embodiment as illustrated in FIG. 1, the connection 11 may be in the form of a cable connecting the interface 12 and the coupling means 4. When the lowest landing door is opened with a triangular emergency opening key, the connection 11, e.g. in the form of a cable, transmits force to the coupling means 4 and triggers said lateral movement of the coupling members 14, e.g. by releasing a holding means 18 (such as a latch, not showed) comprised in the coupling means 4. Said holding means 18, when in unreleased (i.e. holding) condition, hold the coupling member 14 in inactivated state against force of gravity and/or against force of an auxiliary spring means. In said triggering, this holding is ceased, and the coupling member 14 moves (in this case dropped down) laterally to collision course with coupling members 13.

The coupling member 14 can transmit vertical reaction force to the coupling member 13 when they collide. Said laterally movable coupling member 14 is in the preferred embodiment pivotal. Thus, it is laterally movable to collision course with coupling members 13 by pivoting around an axis. To enable said vertical reaction force, the range of pivoting movement is preferably limited such that the coupling member 14 cannot pivot over and away from the position where said collision course with coupling members 13 is realized. The second coupling means may for this purpose comprise a limiting means 15 for pivoting of the coupling member 14. It is not necessary that said lateral movement is realized by pivoting of coupling member 14. Alternatively, the laterally movable coupling member could be movable with linear movement, such as linear horizontal movement.

In the preferred embodiment, the coupling members 13,14 of said first and second coupling means (3,4) are in the form of stop members having a stop surface, the stop surface of the members 13 of the first coupling means 3 facing said end of the hoistway and the member(s) 14 of the second coupling arrangement facing the opposite direction. In this way the arrangement is simple to form such that there are the second coupling means can effectively block or at least limits vertical movement of the first coupling means when they are coupled to each other. A laterally open free space is located vertically between successive coupling members 13 at different vertical levels into which space a coupling member 14 of the other of said first and second coupling means (3,4) can be laterally moved by moving coupling member(s) 14 of one of said coupling means laterally. In the preferred embodiment as illustrated in FIGS. 1 to 4, the coupling members 14 of the second coupling means 4 are in this way movable. This is preferable, because in this way the moving is easy to trigger from position separate from the car, such as from the landing L. Also, in this way the additional movable structures need not be placed in unity of the car 1.

FIG. 2 illustrates preferred details for the embodiment of FIG. 1. The car brake 2 is functionally connected to the first coupling means 3 such that it is triggerable by movement of the first coupling means 3, especially by movement of movable coupling member(s) 13 of the first coupling means 3. The first coupling means 13 are mechanically connected to the brake 2 with a lever arrangement 21. The lever arrangement 21 is arranged to transmit movement of any one of the coupling members 13 to movement of a wedging part 22 placed between a tapered wedging surface of the brake body and a surface of the elevator guide rail G. Vertical movement of the coupling member(s) 13 moves the wedging part deeper into a convergent gap between the guide rail G and the brake body. Further movement of the elevator car 1 will increase the wedging effect and the car movement is finally stopped. The structure of the brake can be corresponding as that of a safety gear, which is a commonly known elevator component. In fact, it is preferable that said brake 2 additionally functions as a safety gear. Accordingly, it is preferable that said brake 2 can also be triggered with an overspeed governing device 5 as illustrated in FIG. 1, i.e. based on car speed. This is however not necessary. The brake 2 as illustrated in FIG. 2 is able to stop movement of the elevator car 1 in one direction. The brake 2 could alternatively be in the form of a two-directional safety gear well known in the field of elevator technology, whereby it could brake and stop the car in two directions. In this way, a safety space could be formed in both of the two ends of the hoistway in corresponding manner. In this case, a second coupling means 4 would be positioned at proximity of each of the two ends of the hoistway. Instead of the preferred arrangement of FIG. 2 alternatively another type of arrangement for connecting the coupling means 3 to brake 2 such that movement of coupling means 3 causes brake triggering. For example, the brake 2 could be a hydraulically or electrically operable brake instead of lever arrangement. In that case, the arrangement would comprise an actuator, such as a spring-powered actuator or a hydraulic actuator or a solenoid actuator. The brake 2 could also differ in type, as it is not necessary that it is a wedging type of brake. For example, the brake could alternatively be in the form of a disc brake.

FIG. 2 illustrates preferred details for the embodiment of FIG. 1, especially for the structure of the first coupling means 3 and preferred functional interplay between the first and second coupling means 3,4. In this embodiment, the first coupling means 3 having coupling points at different levels comprises a vertically elongated rigid object comprising said coupling members 13 at different vertical levels for forming said coupling points. The rigid object is in the form of a vertically elongated plate having plurality of edges for forming of said coupling members at different levels facing towards said end of the hoistway. In particular, the plate has a plurality of vertically spaced cutouts forming said edges. In particular the cutouts are holes at intervals as above each other. The coupling members are formed by the plate section between successive cutouts. The plate is placed parallel with the car wall and mounted vertically movably on the car 1. In this way, the lateral space consumed by the first coupling means 3 is minimized. The structure is also very simple and cheap to manufacture. In this way, a great number of coupling points/coupling members can be formed in space efficient manner. The coupling member 14 of the second coupling means is movable laterally to and away from the cutouts. The coupling member is movable by pivoting around an axis parallel to said plate and/or car wall.

Figure 4:
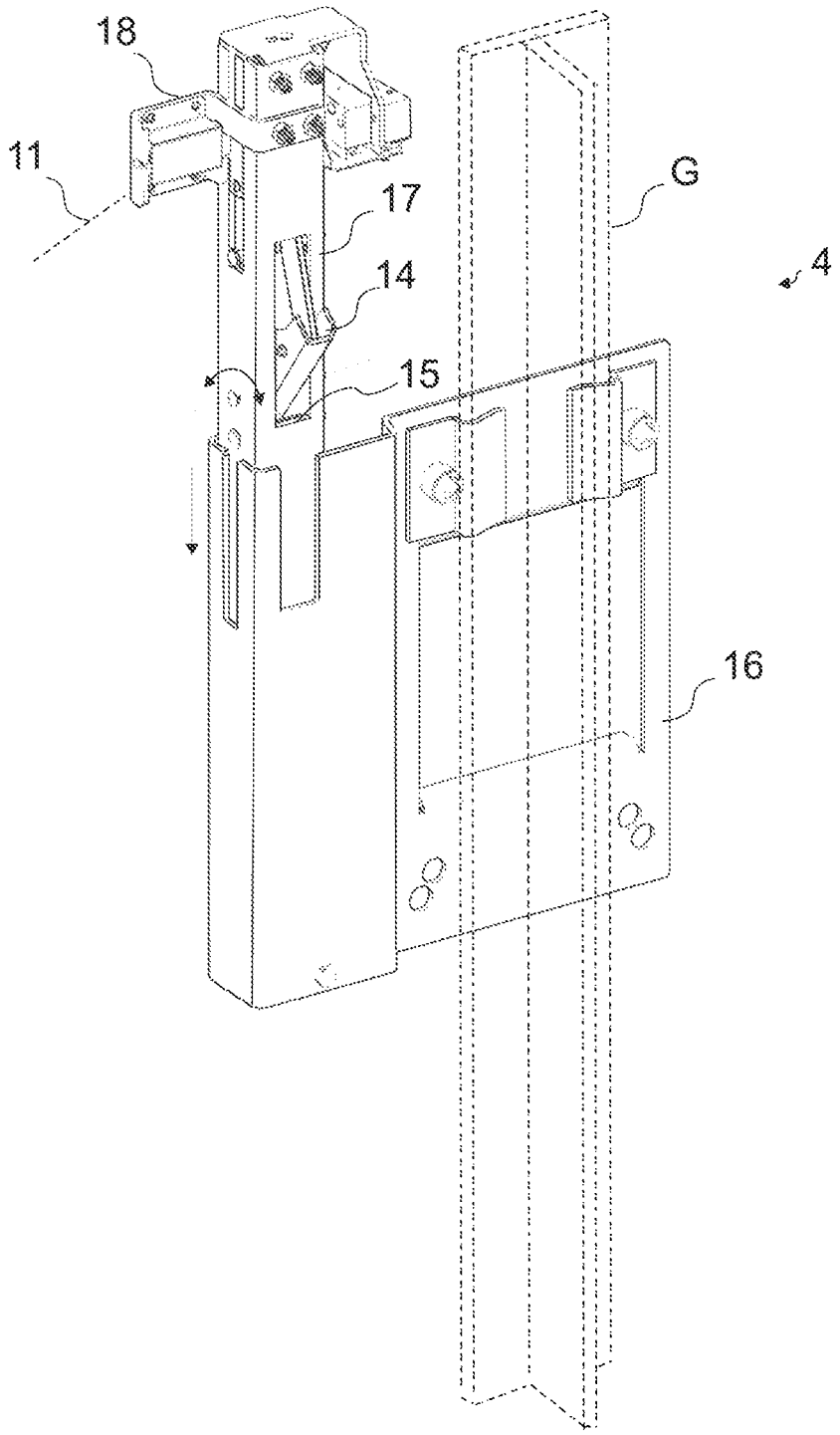
FIG. 4 illustrates a preferred structure for the second coupling means of FIGS. 1-3.

FIG. 4 illustrates the second coupling means 4 with preferable details. The second coupling means 4 are arranged to be mounted on a stationary structure, which is in this case an elevator guide rail G. The coupling member 14 thereof may be arranged to be movable a limited length (see the vertical arrow) in vertical direction towards said end of the hoistway such that after collision of the coupling members 13,14 the coupling members 14 can move towards said end pushed by the coupling members 13. This length is preferably at most 1 meter, more preferably less than 50 cm. The second coupling means 4 are arranged to resist this vertical movement. In this way the brake triggering movement is early initiated and yet the parts where brake triggering movement is caused is less likely to be able to return back to normal condition soon after collision. Also, in this way the coupling members or other structures are not broken after collision due to continuance of the movement for a certain braking length. In order to achieve one or more of these properties in the preferred embodiment the second coupling means 4 comprise a mounting base 16 to be fixed on a structure G, and a body 17 carrying the coupling member 14 of the second coupling means 4. The body 17 is mounted movably on the mounting base 16 but with a limited vertical moving range. There may be means (not shown) for resisting and/or limiting the movement of the body 17 relative to the mounting base 16. These means may comprise a spring means for resisting vertical movement of the body 17, such as a compression spring between the body 17 and the mounting base 16 but this is not necessary. Alternatively, the body 17 and the mounting base 16 may be fixed to each other with a friction connection. The relative movement of the body 17 and the mounting base 16 is preferably guided by guiding means, such as their vertically elongated surfaces opposing each other. For this purpose the mounting base 16 and the body 17 have tubular cross-shapes telescopically movable relative to each other.

The second coupling means 4 also include preferably, but not necessarily, the ability to yield when the elevator car is moved away from the end at proximity of which this second coupling means 4 is positioned. In particular, the second coupling means 4 is positioned at proximity of and end (in Figures a lower end) of the of the hoistway S, and when the coupling means (3,4) are coupled, movement of the first coupling means 3 away from the end (in Figures upwards) is configured to release the coupling between said coupling means 3,4, and movement of the first coupling means 3, especially coupling member(s) thereof, toward the end (in Figures downwards) is configured to be blocked or at least resisted by the second coupling means 4, especially by coupling members 14 thereof. In the solution as illustrated in FIGS. 1-4, this yielding is achieved as the coupling member 14 of the second coupling means 4 is arranged to pivot to one direction only from the state of collision course, and pivoting of the member 14 in this pivoting direction can be caused by moving the coupling member 13 away from the close end of the hoistway S (in Figures upwards). Accordingly, the car 1 can be driven towards safe direction even while the safety space is formed.

In the method a safety space s is formed between elevator car and an end of the elevator hoistway S, the elevator being as described above. In the method before a person enters the hoistway S the elevator is temporarily set to activated condition. In the activated condition coupling between said first and second coupling means takes place if the car 1 is in such a position or is later moved to such a position where said first and second coupling means 3,4 are level with each other. Accordingly, if the car 1 is at the time of activation positioned such that said first and second coupling means 3,4 are level with each other coupling is performed and if not then the coupling will be performed if the car 1 later reaches such a position that said first and second coupling means are level with each other. Due to the specific construction of the coupling means 3,4, as earlier described, a safety space s can be reliably in formed with the method wherever the car 1 is positioned. The elevator can be set to activated condition by moving the coupling members of the first and second coupling means 13,14 on collision course with each other. After activation, the person enters the hoistway S. After this the person exits the hoistway. After this, the elevator is set away from said activated condition to inactivated condition, in which inactivated condition coupling between said first and second coupling means is not possible. In this way the elevator is set back to normal operation condition. For ensuring the independence of the car position, it is preferable that in the activated condition, the coupling member(s) 14 of the second coupling means are on collision course with all the coupling members 13 at different vertical levels of the first coupling means.

In the preferred embodiment as shown in Figures said second coupling means 4, including the coupling member(s) 14 thereof, are mounted at proximity of the lower end of the hoistway S. The mounting position of the second coupling means 4 affects the height of the safety space formed with the arrangement. This mounting position is at proximity of the lower end of the hoistway S preferably at a predetermined distance from the lower end of the hoistway, but preferably below the halfway of the hoistway height. The second coupling means 4 is mounted on a stationary structure, such as a stationary structure of the hoistway S. Elevator guide rail(s) form a preferred mounting base for the second coupling means 4, because thus the vertical position of the coupling means can be easily adjusted optimal. The Figures show the lower end of the hoistway being the end in which the safety space s is formed. However, a safety space can be alternatively arranged to be formed in the upper end of the hoistway in a corresponding manner. In that case, the devices could work oppositely in the vertical sense. Of course, a safety space can be alternatively arranged to be formed in the upper end of the hoistway in this manner. In this case, the brake 2 would be preferable to construct two-directional such that it can be triggered to brake in two directions. Thus, there's no need to have a several brakes. In this case, also the movably mounted coupling means would be mounted movably on both vertical directions.

The elevator is preferably of the type having low pit. Especially, the vertical distance d between the pit floor and the sill of the lowest landing is preferably less than 1 meter, but may be even less than 0.5 meters.

As illustrated in context of the preferred embodiment, it is preferable that the first coupling means has the coupling points at different vertical levels. However, alternatively it is also possible that the second coupling means has said coupling points at different vertical levels. In that case, said first and second coupling means (3,4) are positioned relative to each other such that said coupling points are successively passed by said other of the first and second coupling means (3,4) when car 1 moves towards said end of the hoistway with unidirectional movement.

It is to be understood that the above description and the accompanying figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. An elevator comprising:

a hoistway;

an elevator car configured to move in the hoistway, the elevator car including a car brake; and a first coupler on the elevator car such that the first coupler is configured to one of move with the elevator car and relative to the elevator car based on a coupling state, the first coupler including a plurality of coupling members spaced a distance apart at different vertical levels; and a second coupler on a stationary structure at proximity of a bottom of the hoistway, the second coupler being selectively activated to couple in a force-transmitting manner with one of the plurality of coupling members when in the coupling state to trigger the car brake such that each of the plurality of coupling members is configured to couple with the second coupler to trigger the car brake based on a relative position between the first coupler and the second coupler when the elevator car moves in a downward direction towards the bottom of the hoistway.

2. The elevator of claim 1, wherein the second coupler includes a coupling member, and the plurality of coupling members of the first coupler form a plurality of coupling points with the coupling member.

3. The elevator of claim 2, wherein the first coupler and the second coupler are configured to couple to each other by moving the plurality of first coupling members of the first coupler and the coupling member of the second coupler into contact.

4. The elevator of claim 2, wherein the car brake is configured to trigger based on movement of the first coupler, the first coupler movably coupled to the elevator car, the first coupler being coupled with the second coupler, and the plurality of first coupling members engaging with the coupling member.

5. The elevator of claim 2, wherein the plurality of first coupling members are configured to laterally move to and away from a position when on a collision course with the coupling member.

6. The elevator of claim 5, wherein the plurality first coupling members and the coupling member are laterally movable by pivoting around an axis parallel to a vertically elongated plate and a car wall.

7. The elevator of claim 1, wherein a free and laterally open space is at an end-side of each of the plurality of coupling members, and the second coupler includes a coupling member, the coupling member is configured to laterally move within the free and laterally open space.

8. The elevator of claim 7, wherein the free and laterally open space is successively located vertically between the plurality of coupling members.

9. The elevator of claim 1, wherein the plurality of coupling members include at least 3, 5, 8, or 10 coupling members at the different vertical levels.

10. The elevator of claim 1, wherein the plurality of coupling members are distributed over a vertical length of more than 1 meters.

11. The elevator of claim 1, wherein the plurality of coupling members are at 15 different vertical levels and include a lowermost coupling member and an uppermost coupling member.

12. The elevator of claim 11, wherein the plurality of coupling members at different vertical levels include a vertically elongated structure, the vertically elongated structure including a vertically elongated plate having a plurality of edges, the plurality of edges corresponding to a plurality of coupling points.

13. The elevator of claim 12, wherein the vertically elongated plate is parallel with a wall of the elevator car.

14. The elevator of claim 1, wherein the stationary structure includes a guide rail.

15. A method for forming a safety space between an elevator car and a bottom of an elevator hoistway via a first coupler and a second coupler, the first coupler on the elevator car such that the first coupler is configured to one of move with the elevator car and relative to the elevator car based on a coupling state, the first coupler including a plurality of coupling members spaced a distance apart at different vertical levels, the method comprising:

selectively activating the second coupler to set the second coupler to the coupling state; and coupling one of the plurality of coupling members of the first coupler and the second coupler in a force-transmitting manner to trigger the car brake such that each of the plurality of coupling members is configured to couple with the second coupler based on a relative position between the first coupler and the second coupler when the elevator car moves in a downward towards the bottom of the hoistway.

16. The method of claim 15, wherein the coupling of the first coupler and the second coupler creates the safety space between the elevator car and the bottom of the elevator hoistway.

17. The method of claim 15, wherein the selectively activating includes setting the first coupler and the second coupler on a collision course with each other.

18. The method of claim 15, wherein the second coupler includes a coupling member, and the coupling includes coupling one of the plurality of coupling members to the coupling member.

* * * * *